US006161927A

United States Patent [19]

Long et al.

[11] Patent Number: 6,161,927

[45] Date of Patent: Dec. 19, 2000

[54] INK JET PRINTER CARTRIDGE WITH PRESS-ON LID

[75] Inventors: Gregory Alan Long; James Harold Powers, both of Lexington; Matthew Joe Russell, Stamping Ground; Julie Ann Gordon Whitney, Georgetown; Stephen Francis DeFosse; James Michael Rioux, both of Lexington, all of Ky.

[73] Assignee: Lexmark International, Inc., Lexington, Ky.

[21] Appl. No.: 09/512,571

[22] Filed: Feb. 24, 2000

[51] Int. Cl.[7] ..... B41J 2/175

[52] U.S. Cl. ..... 347/86

[58] Field of Search ..... 347/85, 86, 87, 347/46, 25; 141/18

[56] References Cited

U.S. PATENT DOCUMENTS

| | | | |
|---|---|---|---|
| 4,432,004 | 2/1984 | Glattli | 347/28 |
| 4,992,802 | 2/1991 | Dion et al. | 347/87 |
| 5,408,134 | 4/1995 | Cowger et al. | 222/1 |
| 5,408,256 | 4/1995 | Keen et al. | 347/87 |
| 5,428,381 | 6/1995 | Hadimioglu et al. | 347/46 |
| 5,488,400 | 1/1996 | Crystal et al. | 347/85 |
| 5,631,682 | 5/1997 | Takara | 347/86 |
| 5,661,510 | 8/1997 | Brandon et al. | 347/87 |
| 5,663,753 | 9/1997 | Story et al. | 347/86 |
| 5,751,324 | 5/1998 | Brandon et al. | 347/87 |
| 5,967,196 | 10/1999 | Moser | 141/18 |
| 5,975,677 | 11/1999 | Marler et al. | 347/40 |

*Primary Examiner*—N. Le
*Assistant Examiner*—Anh T. N. Vo
*Attorney, Agent, or Firm*—Luedeka, Neely & Graham; Michael T. Sanderson

[57] ABSTRACT

An ink printer cartridge having a press-on lid and the method of make the same is described. An ink reservoir body is having an open-ended cavity and a foam insert is disposed therein. A spacer having a plurality of holes is fixedly attached to the top of the ink reservoir body as by ultrasonic welding. The reservoir is then filled with ink through the plurality of holes in the spacer. A reservoir lid having a plurality of connecting posts is then attached to the spacer by engaging the connecting posts of the lid into the holes of the spacer.

26 Claims, 5 Drawing Sheets

INK JET PRINTER CARTRIDGE WITH PRESS-ON LID

FIELD OF THE INVENTION

This invention relates to cartridges for ink jet printers. More particularly the invention relates to an ink jet printer cartridge having an improved closure lid design.

BACKGROUND OF THE INVENTION

Ink jet printers typically provide ink to the printheads by means of an ink jet cartridge. The cartridge provides a storage well in which printing ink is stored until used with the printheads. The ink jet cartridge is connected to the printhead so as to allow flow of ink from the cartridge to the printhead when needed.

Currently, filled ink jet cartridges are produced by first forming the main body of the cartridge. The main body constitutes a bottom and four side walls defining an ink cavity of the ink jet cartridge. A foam piece is then typically pressed into the body cavity of the cartridge, and the cavity and foam piece are then filled with ink by means of an open-ended top. Lastly, a cover is placed on the now ink filled main body and attached to the side walls thereto. Typically this attachment is made by means of an ultrasonic weld which may vibrate the cartridge at a frequency of 20 to 40 kHz. The weld completely seals the cover to the side walls of the ink jet cartridge.

This process suffers from several drawbacks. Most importantly, the ink is agitated by the vibration of the ultrasonic welding process. Vibrating the ink filled cartridge at such high frequencies tends to produce and entrain small air bubbles in the ink. These bubbles in turn can cause problems with print quality. Additionally, the process completely seals the top of the ink jet cartridge allowing no gas flow. Therefore, an equalization vent must be formed somewhere else on an upper portion or cover of the cartridge to allow the pressure in the cartridge to equalize with the ambient pressure outside of the cartridge to ensure proper ink flow. The size of the hole and the path of gas flow through it must be carefully controlled so as to prevent the ink from being spilled or evaporating in significant quantities. However, the vent hole must allow enough gas flow for inside and outside gas pressures to equalize.

It is an object of the invention to provide an improved ink jet cartridge.

It is another object of the invention to provide a method for assembling an ink jet cartridge which reduces air bubble formation in the ink.

A further object of the invention is to provide an ink jet cartridge having improved venting for gas pressure equalization.

SUMMARY OF THE INVENTION

With regard to the foregoing and other objects and advantages, the invention provides an ink jet printer cartridge having an ink reservoir body having a bottom portion and side portions with each side portion having a top wall edge defining a reservoir periphery and being attached to the bottom portion along side wall bottom edges thereby defining an open-ended cavity; a foam insert disposed in the open-ended cavity; a spacer having a first side, a second side, and a plurality of holes formed therein which is fixedly attached to the ink reservoir periphery along the top wall edges; and a reservoir lid having a plurality of connecting posts. The connecting posts are configured to nonhermetically engage the plurality of holes formed in the spacer thereby fixedly connecting the reservoir lid to the spacer.

In another aspect the invention provides a method of making an ink jet printer cartridge. An ink reservoir body is provided which has a bottom portion and side portions. The side portions each have a top wall edge which defines a reservoir periphery and are attached to the bottom portion along side wall bottom edges so as to define an open-ended cavity. A foam insert is disposed into the cavity of the ink reservoir body. A spacer, which has a first side, a second side, and a plurality of holes formed therein, is attached to the ink reservoir periphery along its top wall edges. The reservoir is filled with ink by means of the holes in the spacer. A reservoir cover, which has a plurality of connecting posts, is then attached to the spacer. The connecting posts are configured to nonhermetically engage the plurality of holes in the spacer so as to fixedly connect the reservoir lid to the spacer.

In yet another aspect the invention provides a cartridge suitable for ink jet printing. The cartridge comprises an ink supply reservoir piece, a foam insert, a volume of printing ink, a spacer, and a reservoir cover. The ink supply reservoir piece has a bottom portion and side portions with each side portion having a top wall edge defining a reservoir periphery and being attached to the bottom portion along side wall bottom edges thereby defining an open-ended ink supply reservoir. The foam insert is diposed in this ink supply reservoir. A volume of printing ink is contained within the ink supply reservoir. The spacer has a first side, a second side, and a plurality of holes formed therein and is fixedly attached to the supply reservoir periphery along the top wall edges. The reservoir cover has a plurality of connecting posts which are configured to nonhermetically engage the plurality of holes formed in the spacer so as to fixedly connect the reservoir cover to the spacer.

An advantage of the ink jet printer cartridge of the invention is no ultrasonic welding or other vibratory or agitating operation are performed on the cartridge after it is filled with ink. Typically, ink jet printer cartridges must be ultrasonically welded to seal them after being filled with printing ink. The vibration of the welding process leads to bubble formation in the ink and subsequent reduced ink print quality. By not subjecting the ink to welding or other vibratory or agitation processes, bubble formation in the ink is greatly reduced.

Another advantage of the invention is that improved air vents for gas pressure equalization of the ink in the cartridge are provided. Cartridges typically require one or more holes in the cartridge body or cover to equalize the pressure in the cartridge with the ambient air pressure and allow for ink flow. An elaborate gas flow path for channeling gases is required to enable adequate gas pressure equalization. In order to avoid multiple welding steps and the potential for ink leakage, the gas channeling device is typically made as a unitary construction with the cover. In contrast to conventional covers, the present invention uses a separate channeling device which is welded to the cartridge body. The holes in the channeling device and connecting posts on the cover provide multiple gas flow paths for pressure equalization and, because of the frictional fit between the channeling device and cover, does not require an additional welding step.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF PREFERRED EMBODIMENTS

Figure 1:
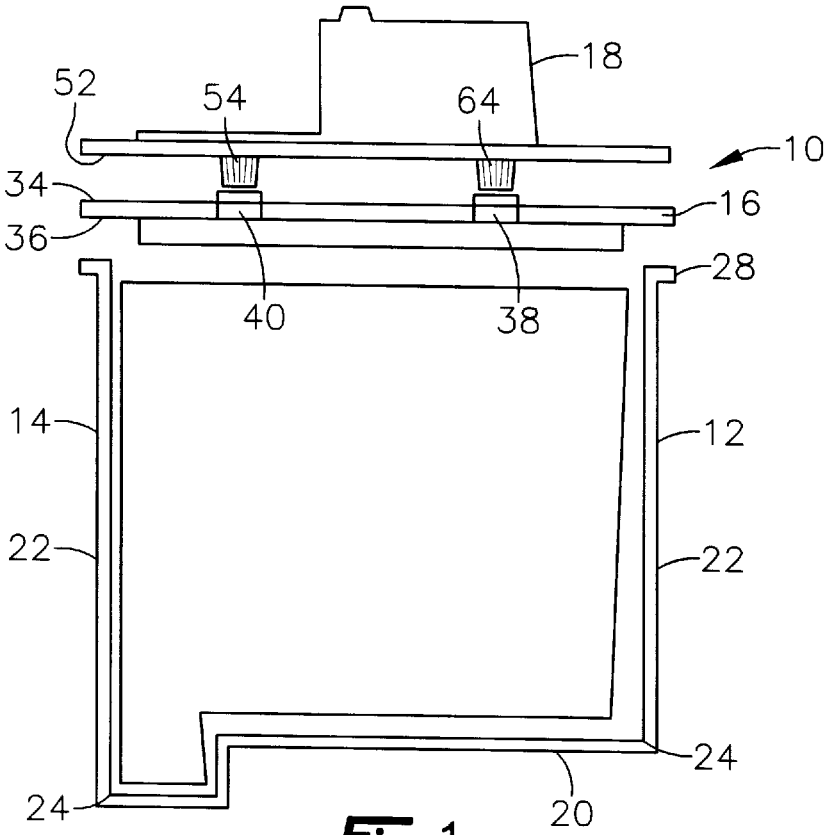
FIG. 1 is a cross-sectional view, not to scale, of an ink cartridge assembly according to the invention.
Figure 2:
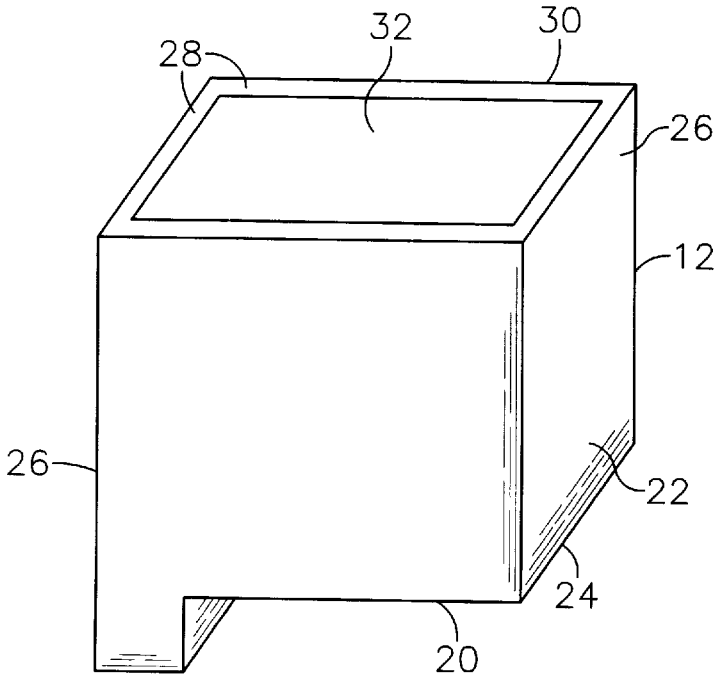
FIG. 2 is a perspective view of a cartridge body according to the invention.

With reference to FIGS. 1 and 2, there is shown an ink jet printer cartridge 10 having an ink reservoir body 12, a foam insert 14 which is disposed within the ink reservoir body 12, a spacer 16 which is fixedly attached to the ink reservoir body 12, and a reservoir cover 18 which is fixedly connected to the spacer 16.

The ink reservoir body 12 serves as the storage receptacle for the foam insert 14 and the printing ink contained therein. The ink reservoir 12 may be constructed of any suitable material for liquid storage devices so long as the material does not react with the printing ink. Since the ink reservoir body 12 and the entire ink jet printer cartridge 10 must be reciprocated rapidly in the operation of an ink jet printer the ink reservoir body 12 is preferable constructed of a material which is both durable and lightweight, such as a thermoplastic material. Preferred thermoplastic materials may be selected from polyphenylene oxide/polystyrene alloys, polypropylene, acrylonitrile/butadiene/styrene terpolymers, polystyrene/butadiene alloys or copolymers, polyetherimide, polysulfone, polyesters and the like. A particularly preferred material is a modified polyphenylene oxide material available from General Electric Company of New York, N.Y. under the trade name NORYL. These materials may be formed by processes well known in the art such as injection molding, thermoforming, blow molding and the like.

Figure 4:
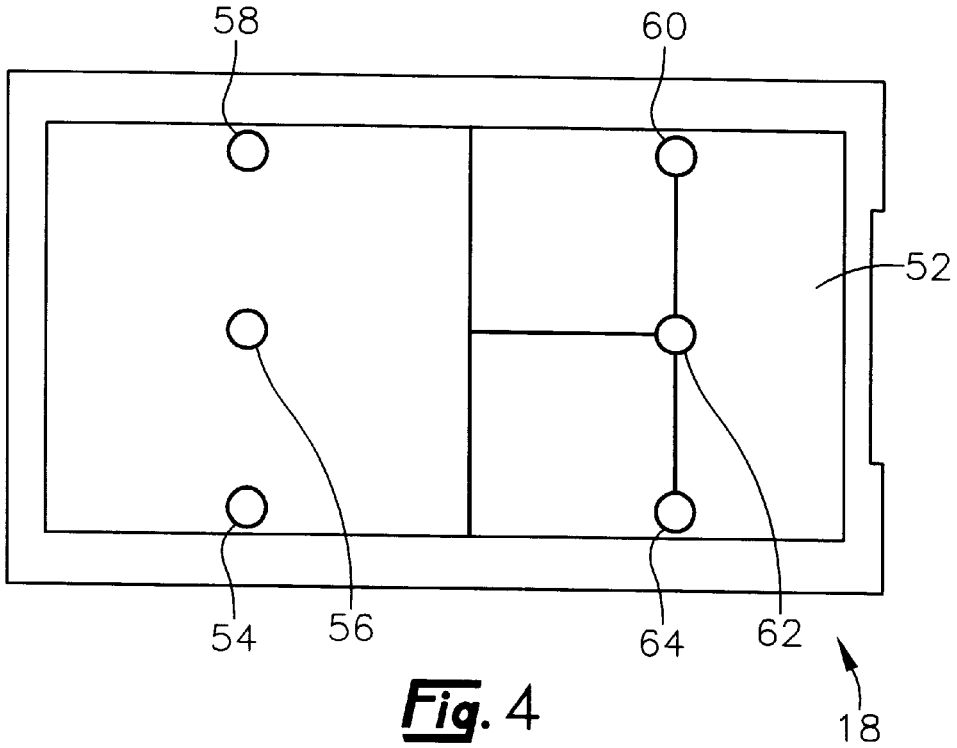
FIG. 4 is a bottom plan view of a cartridge cover according to the invention.

As constructed, the ink reservoir body 12 has a bottom portion 20 and four side portions 22. The side portions 22 serve as the side walls of the ink reservoir body 12 and have side wall bottom edges 24 and are joined to the bottom portion 20 along these side wall bottom edges 24. The side portions 22 also have side wall side edges 26 along which the side portions 22 are joined to one other (FIG. 4). The side portions 22 have top wall edges 28 which together define a reservoir periphery 30. The reservoir periphery 30 is of sufficient width and thickness as to provide a contact surface to which the spacer 16 can later be fixedly attached.

The ink reservoir body 12 is generally in the shape of an open-faced prism, preferably a open faced rectangular prism and has an open-ended cavity 32 defined by the combination of the bottom portion 20, the side portions 22, and the reservoir periphery 30. Preferably the cavity 32 has a generally cubical shape.

With reference again to FIG. 1, a foam insert 14 is disposed within the open-ended cavity 32 of the reservoir body. The foam insert 14 acts as a sponge to absorb and wick printing ink within the ink jet printer cartridge 10. The foam insert 14 may be formed of any suitable spongelike material. For instance, the foam insert may be a reticulated or open cell foam such as a polyurethane foam formed from the polymerization of a polyol and toluene diisocyanate as is well known in the art or from other suitable foams. Preferably the foam insert is formed of a felted polyurethane material.

The shape and size of the foam insert 14 are determined in accord with the size and shape of the open-ended cavity 32 of the ink reservoir body 12. Preferably the foam insert 14 is slightly larger than the shape and size of the open-ended cavity 32 so that the foam insert 14 is compressed within the cavity.

The spacer 16 is fixedly attached to the ink reservoir body 12 along its reservoir periphery 30. Like the ink reservoir body 12, the spacer 16 is preferably formed from a lightweight, durable material such as a thermoplastic material selected from polyphenylene oxide/polystyrene alloys, polypropylene, acrylonitrile/butadiene/styrene terpolymers, polystyrene/butadiene alloys or copolymers, polyetherimide, polysulfone, polyesters and the like. A particularly preferred material is a modified polyphenylene oxide material available from General Electric Company of New York, N.Y. under the trade name NORYL. These materials may be formed by processes well known in the art such as injection molding, thermoforming, blow molding and the like.

Figure 3:
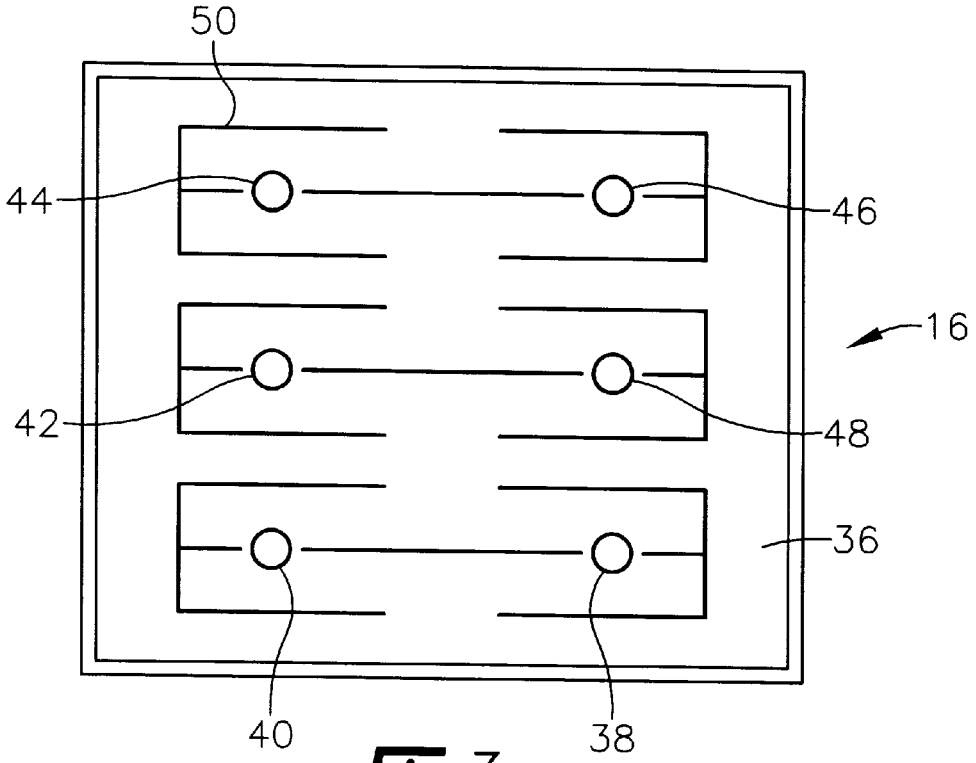
FIG. 3 is a bottom plan view of a spacer assembly according to the invention.

With reference to FIG. 3, the spacer 16 has a first side 34, a second side 36 and a plurality of holes such as holes 38, 40, 42, 44, 46, and 48 formed in and through the spacer. The plurality of holes are used to fixedly connect the reservoir lid to the spacer and provide gas flow passage vias for pressure equalization in the cartridge. While any plurality of holes formed in the spacer is suitable, the spacer 16 preferably has at least six holes formed therein.

The spacer 16 is fixedly attached to the ink reservoir body 12 preferably by means of ultrasonic welding. When being attached the spacer 16 is positioned so that the second side 36 contacts the ink reservoir periphery 30 along the top wall edges 28 of the ink reservoir body 12.

The means of fixedly attaching the spacer 16 to the ink reservoir body 12 will depend on the materials chosen for construction of the ink reservoir body 12 and the spacer 16. When the ink reservoir body 12 and the spacer 16 are both formed from thermoplastic materials, they are preferably fixedly attached to one another by a plastic welding technique such as ultrasonic welding which is known in the art. However, other techniques for fixedly attaching the spacer 16 to the reservoir body 12 may be used so long as a durable and complete seal is formed between the two pieces to substantially prevent ink leakage or evaporation therefrom. For example, the spacer 16 and the reservoir body 12 may be fixedly attached by adhesives, clamps and gaskets, screws, bolts, laser, infrared welding and the like.

It will be appreciated that, since the fixed attachment of the spacer 16 to the reservoir body 12 substantially seals the open-ended cavity 32 except for the plurality of holes 38–48 formed in the spacer 16, the foam insert 14 must be disposed in the open-ended cavity 32 before fixedly attaching the spacer 16 to the reservoir body 12.

In one embodiment of the invention, the spacer 16 also preferably includes a grid structure 50 which extends below the second side 36 of the spacer 16 and extends into the cavity 32 of the reservoir body 12 so as to contact and compress the foam insert 14.

After the spacer 16 is fixedly attached to the reservoir body 12, the cavity 32 of the reservoir body 12 and foam insert 14 may now be filled with a volume of printing ink. The printing ink may be any ink suitable for ink jet printing equipment including pigment and dye based inks such as described in U.S. Pat. Nos. 5,198,022 to Aulick et al., 5,254,160 to Beach et al., 5,494,507 to Beach et al., 5,589,522 to Beach et al., 5,656,071 to Kappele et al., and 5,925,692 to Kappele et al the disclosures of which are incorporated herein by reference as if fully set forth. The ink may be black ink or may be colored ink such as cyan, magenta, or yellow. The ink is transferred into the cavity 32 of the reservoir body 12 by means of the plurality of holes 38–48 formed in the spacer 16. A syringe or tube may be temporarily inserted through one or more of the holes and ink transferred into the cavity thereby. Of course, since the foam insert 14 is disposed within the cavity 32, a substantial portion of the ink transferred into the cavity 32 is absorbed and retained within the porous material of the foam insert 14; however, such ink is still considered within the cavity 32 of the reservoir body 12.

It will be appreciated that no ink is transferred into the cavity 32 of the reservoir body 12 until after the completion of any processes, such as ultrasonic welding, which may subject the cartridge 10, and its contents to vigorous vibrations and agitation. Because the ink need not be subjected to these processes because of the cover and spacer design, bubble formation in the ink is significantly reduced.

After filling the reservoir with ink, a reservoir lid 18 is fixedly connected to the spacer 16. (See FIGS. 1 and 4). The reservoir lid 18 has a generally planar first side 52 and a second side 54. When fixedly connected to the spacer 16, the reservoir lid 18 is positioned so that the first side 52 faces the first side 34 of the spacer 16.

Extending from the first side 52 of the reservoir lid 18 is a plurality of connecting posts 54–64. The connecting posts are configured to nonhermetically engage the plurality of holes 38–48 formed in the spacer 16 so as to fixedly connect the reservoir lid 18 to the spacer 16. The term "nonhermetically engage," means that the connecting posts 54–64 engage into the plurality of holes 38–48 in the spacer 16 sufficiently so that the reservoir lid 18 is fixedly connected to the spacer 16 as by friction between the outside surface of the posts and the inside circumference of the holes.

Once attached to the spacer 16, the lid 18 cannot be easily removed without the applying substantial force between the spacer 16 and lid 18. However, because of the posts' design the connecting posts 54–64 do not engage the holes 38–48 sufficiently to form an airtight seal between the holes and the connecting posts. As will be apparent, the number, size, and arrangement of the connecting posts on the first side 52 of the reservoir lid 18 is chosen so as to ensure that the connecting posts engage the plurality of holes in the spacer 16. Preferably the bottom side 52 of the reservoir lid 18 has at least 6 connecting posts but may contain more or fewer connecting posts provided the spacer 16 contains at least as many holes as there are posts and the number of posts are sufficient to provide a substantially non-removable connection between the lid and spacer.

The connecting posts 54–64 preferably have a taper, narrowing in diameter away from the first side 52 of the reservoir lid 18 to the distal end of the posts opposite first side 52. However, such tapering is not required and straight, nontapering connecting posts may also be used in the invention.

Figure 5A:
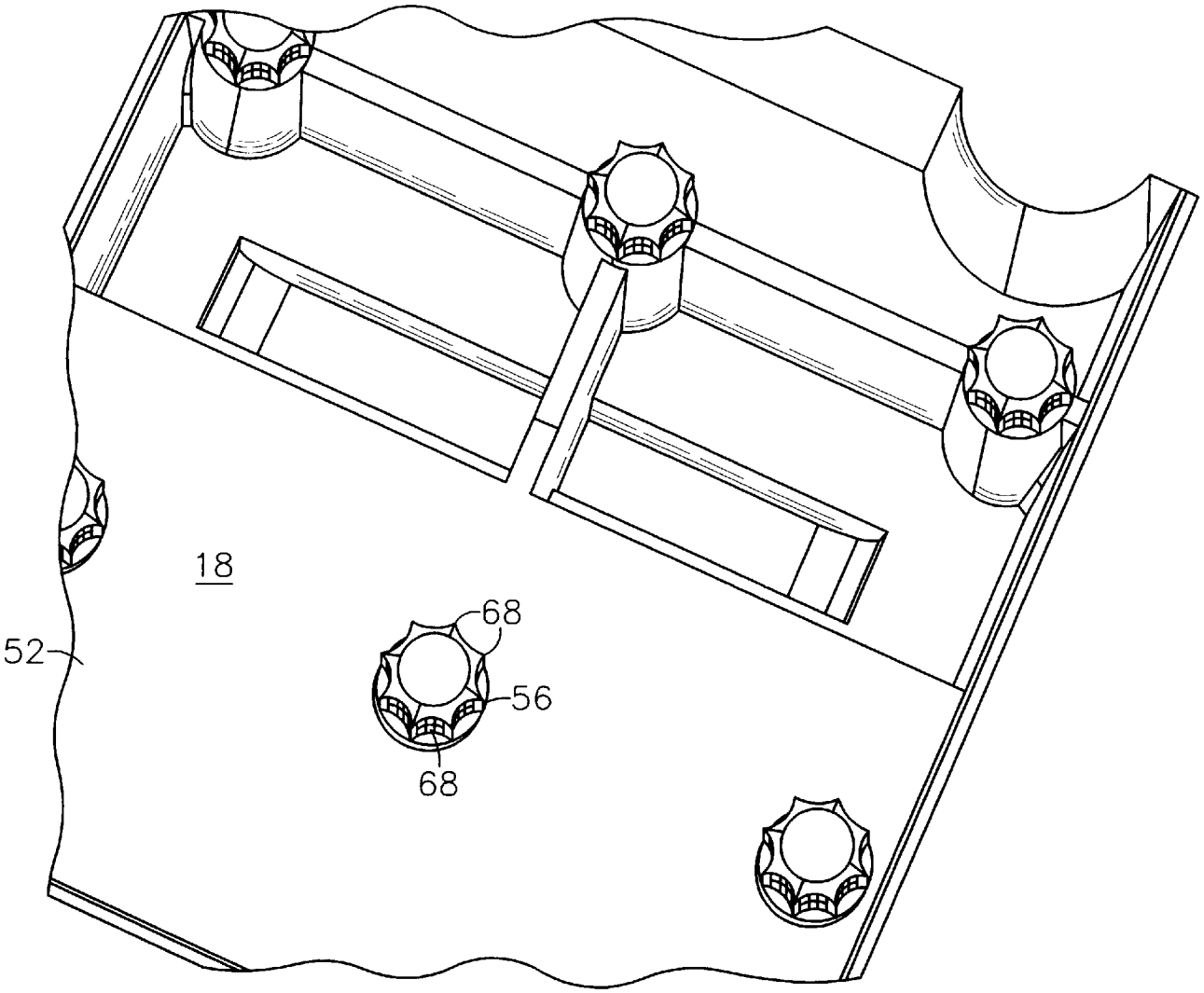
FIGS. 5A and 5B are partial bottom perspective views of cartridge covers according to the invention.
Figure 5B:
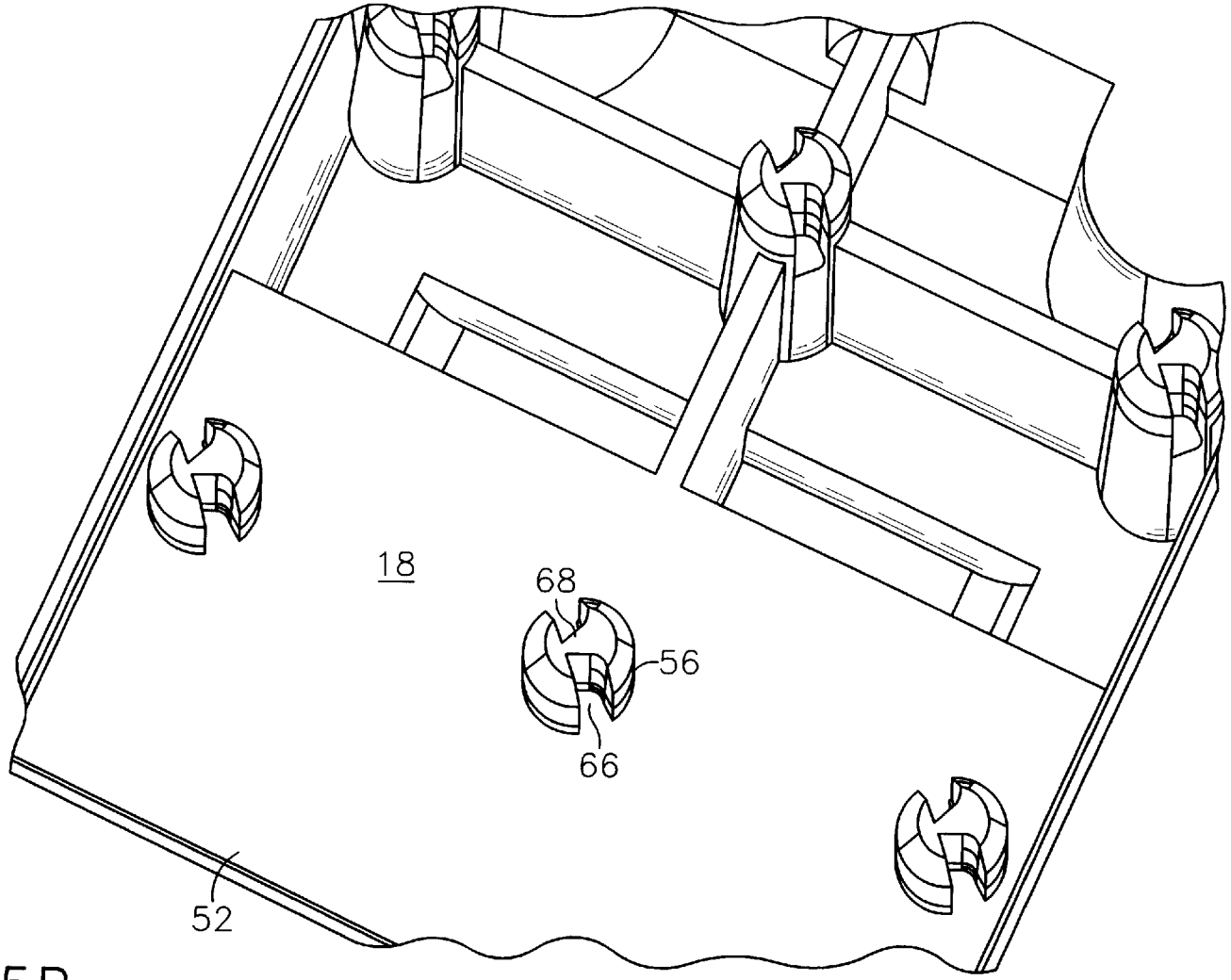

As noted above, the connecting posts 54–64 engage the plurality of holes 38–48 in the spacer 16 nonhermetically. In a preferred embodiment of the invention, this is accomplished by forming within each connecting post such as post 56 at least one gas flow channel 66 as shown in FIGS. 5A and 5B. The gas flow channel 66 provides for gas flow communication between the first side 34 of the spacer 16 and the second side 36 of the spacer 16 while the reservoir lid 18 is fixedly connected to the spacer 16.

Due to the gas flow channel 66, the pressure inside the cavity 32 of the ink reservoir 12 remains substantially equal to that outside of the reservoir 12 even after a substantial portion of the ink volume as been used and consumed. Thus there are fewer problems with ink flow due to pressure inequalities inside and outside of the ink reservoir body 12.

Preferably the gas flow channel 66, while large enough to equalize the gas pressure inside the cavity 32 of the reservoir body 12, is small enough to prevent any significant leakage spillage or evaporation of printing ink through the gas flow channel 66. In this regard, the cross-sectional area of each of the gas flow channels 66 preferably ranges from about 0.25 $mm^2$ to about 2.0 $mm^2$.

In one preferred embodiment of the invention, each connection post also comprises at least one deformable rib structure 68. When the reservoir lid 18 is fixedly connected to the spacer 16, the rib structure 68 deforms so as to allow the connecting posts such as post 56 to more firmly engage the hole in the spacer 16. For instance, a plurality of deformable rib structures 68 may be formed on the outer surface of the connecting post 56 which deform and engage the inner circumference of the hole in the spacer 16. Alternatively, the connection post 56 may have one deformable rib in the center that deforms when the outer surface of the post engages the inner circumference of the spacer hole.

The reservoir lid 18 and its connecting posts 54–64 may be formed from a wide range of materials by a variety of methods similar to those described for the ink reservoir body 12 and the spacer 16. However, as will be appreciated, if the connecting posts comprise a deformable rib structure 68, then the rib structure 68 must be formed of a material which is not harder or more rigid than the material from which the spacer 16 is formed. Preferred materials for the posts 54–64 and associated rib structure include acrylonitrile/butadiene/styrene terpolymers, styrene butadiene alloys or copolymers, polypropylene, polyethyethylene, polystyrene and the like.

Figure 6:
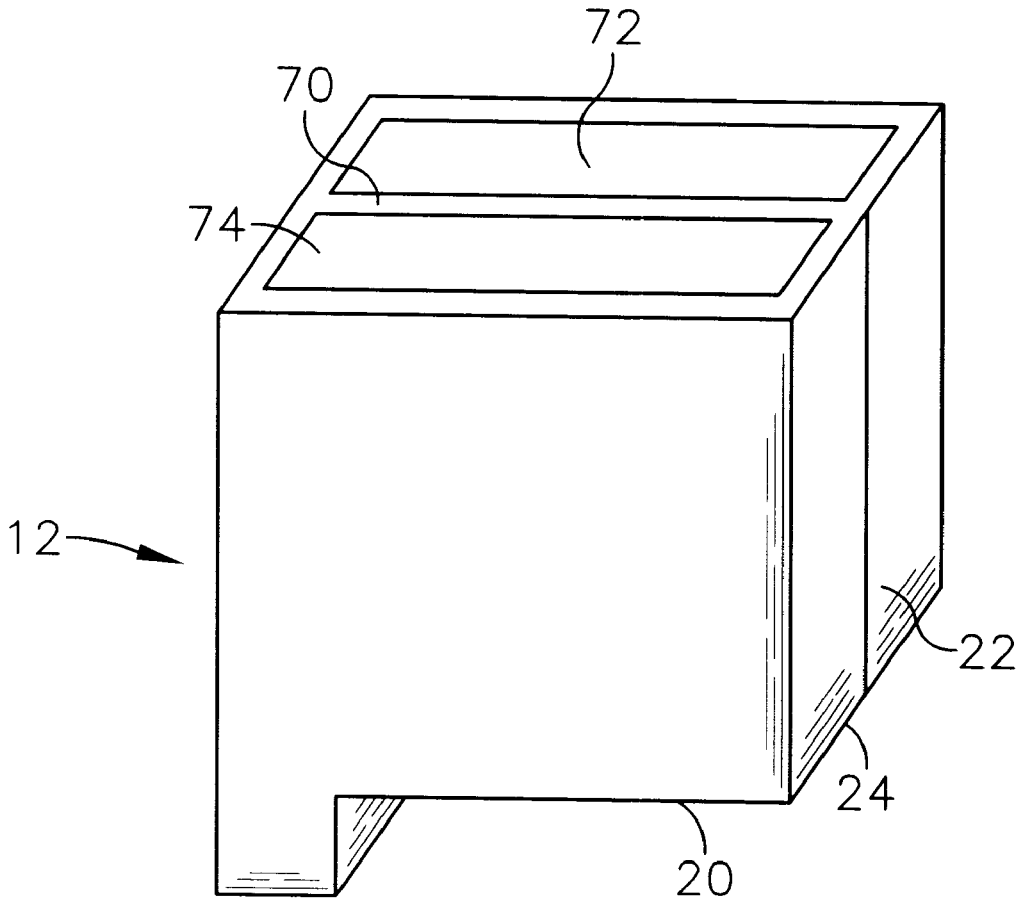
FIG. 6 is a perspective view of an alternate cartridge body design according to the invention.

FIG. 6 shows still another embodiment of the invention, the ink reservoir body 12 may additionally comprise one or more internal common partition walls 70. Partition wall 70 divides the interior of the ink reservoir body 12 into a plurality of open-ended cavities 72 and 74. The common partition wall 70 is made of the same materials as the bottom portion 20 and side portions 22 of the ink reservoir body 12 (FIG. 1) and is formed and attached to the ink reservoir body 12 in analogous manner.

Each of the plurality of open-ended cavities 72 and 74 formed in the ink reservoir body 12 can function as an ink supply reservoir. As described above with reference to FIG. 1, foam inserts may be disposed in the open-ended cavities 72, 74 to absorb and retain ink. Each of the open-ended cavities 72, 74 may be filled with ink by the methods described above and since the cavities are sealed from each other by the partition wall 70, each of the cavities 72, 74 and foam inserts therefor may be filled with a different type and or color or ink. Regardless of the number of cavities and foam inserts, the construction and attachment to the spacer 16 and lid 18 are similar to the methods described above with reference to FIG. 1.

Having described various aspects and embodiments of the invention and several advantages thereof, it will be recognized by those of ordinary skill that the invention is susceptible to various modifications, substitutions and revisions within the spirit and scope of the appended claims.

What is claimed is:

1. An ink jet printer cartridge comprising:

an ink reservoir body having a bottom portion and side portions each having a top wall edge defining a reservoir periphery, said side portions being attached to the bottom portion along side wall bottom edges thereby defining an open-ended cavity;

a foam insert disposed in the open-ended cavity;

a spacer having a first side, a second side, and a plurality of holes formed therein, wherein said second spacer side is fixedly attached to said ink reservoir periphery along said top wall edges; and a reservoir lid having a plurality of connecting posts, said posts being configured to nonhermetically engage with the plurality of holes formed in the spacer whereby the connecting posts fixedly connect said reservoir lid to said spacer.

2. The apparatus of claim 1 wherein the spacer second side additionally comprises a grid structure which contacts and compresses the foam insert within the ink reservoir body.

3. The apparatus of claim 1 wherein the spacer has at least 6 holes formed therein and the reservoir lid has at least 6 connecting posts.

4. The apparatus of claim 1 wherein the connecting posts are tapered.

5. The apparatus of claim 1 wherein each of the connecting posts comprises at least one rib structure which deforms when the connecting posts engage the holes formed in the spacer.

6. The apparatus of claim 1 wherein the connecting posts each comprise at least one gas flow channel such that the second spacer side is maintained in gas flow communication with the first spacer side.

7. The apparatus of claim 1 wherein the spacer is ultrasonically welded to the top wall edges along the reservoir periphery.

8. The apparatus of claim 1 wherein the ink reservoir body additionally comprises a plurality of open-ended cavities separated by common partition walls.

9. The apparatus of claim 8 additionally comprising the foam insert disposed in each of the open-ended cavities.

10. A method for making an ink jet printer cartridge comprising the steps of:

providing an ink reservoir body, the body having a bottom portion and side portions each having a top wall edge defining a reservoir periphery, the side portions being attached to the bottom portion along side wall bottom edges thereby defining an open-ended cavity disposing a foam insert into the ink reservoir body;

attaching a spacer, having a first side, a second side, and a plurality of holes formed therein, to the ink reservoir periphery along said top wall edges;

filling the reservoir and foam insert with ink by means of said spacer holes; and attaching a reservoir lid to the spacer, the lid having a plurality of connecting posts configured to nonhermetically engage the plurality of holes in the spacer whereby the connecting posts fixedly connect the reservoir lid to the spacer.

11. The method of claim 10 wherein the spacer second side additionally comprises a grid structure which contacts and compresses the foam insert within the ink reservoir body.

12. The method of claim 10 wherein the spacer has at least 6 holes formed therein and the reservoir lid has at least 6 connecting posts.

13. The method of claim 10 wherein the connecting posts are tapered.

14. The method of claim 10 wherein the connecting posts each comprise at least one rib structure which deforms when the connecting post engages the holes formed in the spacer.

15. The method of claim 10 wherein the connecting posts each comprise at least one gas flow channel such that the second spacer side is maintained in gas flow communication with the first spacer side.

16. The method of claim 10 wherein the spacer is ultrasonically welded to the top wall edges along the reservoir periphery.

17. An cartridge suitable for ink jet printing comprising:

an ink supply reservoir piece having a bottom portion and side portions each having a top wall edge defining a reservoir periphery, said side portions being attached to the bottom portion along side wall bottom edges thereby defining an open-ended ink supply reservoir;

a foam insert disposed in the ink supply reservoir;

a volume of printing ink contained within the ink supply reservoir;

a spacer having a first side, a second side, and a plurality of holes formed therein, wherein said second spacer side is fixedly attached to said supply reservoir periphery along said top wall edges; and a reservoir cover having a plurality of connecting posts, said posts being configured to nonhermetically engage the plurality of holes formed in the spacer whereby the connecting posts fixedly connect said reservoir cover to said spacer.

18. The apparatus of claim 17 wherein the ink supply reservoir piece is partitioned so as to provide a plurality of open-ended ink supply reservoirs.

19. The apparatus of claim 18 wherein the foam insert is disposed within each of the open-ended ink supply reservoirs.

20. The apparatus of claim 18 wherein each ink supply reservoir of said plurality of said open-ended ink supply reservoir contains a volume of a different color printing ink.

21. The apparatus of claim 17 wherein the spacer second side additionally comprises a grid structure which contacts and compresses the foam insert within the ink supply reservoir piece.

22. The apparatus of claim 17 wherein the spacer has at least 6 holes formed therein and the reservoir cover has at least 6 connecting posts.

23. The apparatus of claim 17 wherein the connecting posts are tapered.

24. The apparatus of claim 17 wherein each of the connecting posts comprises at least one rib structure which deforms when the connecting posts engaged the holes formed in the spacer.

25. The apparatus of claim 17 wherein the connecting posts each comprise at least one gas flow channel such that the second spacer side is maintained in gas flow communication with the first spacer side.

26. The apparatus of claim 17 wherein the spacer is ultrasonically welded to the top wall edges along the reservoir periphery.

* * * * *